US011176890B2

(12) United States Patent
Lu et al.

(10) Patent No.: US 11,176,890 B2
(45) Date of Patent: Nov. 16, 2021

(54) METHOD OF OPERATING A PIXEL CIRCUIT USING DIRECT CHARGING AND THAT PERFORMS LIGHT-EMITTING DEVICE COMPENSATION

(71) Applicant: Sharp Kabushiki Kaisha, Osaka (JP)

(72) Inventors: Tong Lu, Oxford (GB); Michael James Brownlow, Oxford (GB); Tim Michael Smeeton, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/929,767

(22) Filed: Jul. 15, 2020

(65) Prior Publication Data

US 2020/0349889 A1 Nov. 5, 2020

Related U.S. Application Data

(62) Division of application No. 15/937,965, filed on Mar. 28, 2018, now Pat. No. 10,762,843.

(51) Int. Cl.
*G09G 5/10* (2006.01)
*G09G 3/3258* (2016.01)

(52) U.S. Cl.
CPC ... *G09G 3/3258* (2013.01); *G09G 2300/0819* (2013.01); *G09G 2300/0828* (2013.01); *G09G 2300/0852* (2013.01); *G09G 2320/029* (2013.01); *G09G 2320/0233* (2013.01)

(58) Field of Classification Search
None
See application file for complete search history.

(56) References Cited

U.S. PATENT DOCUMENTS

| | | | |
|---|---|---|---|
| 5,714,968 | A | 2/1998 | Ikeda |
| 6,421,103 | B2 | 7/2002 | Yamaguchi |
| 9,171,500 | B2 | 10/2015 | Chaji et al. |
| 9,330,605 | B2 | 5/2016 | Park |
| 2010/0013867 | A1 | 1/2010 | Kim |

(Continued)

OTHER PUBLICATIONS

Office Action for related U.S. Appl. No. 15/937,965 dated Nov. 18, 2019.

(Continued)

*Primary Examiner* — Kirk W Hermann
(74) *Attorney, Agent, or Firm* — Renner, Otto, Boisselle & Sklar, LLP

(57) ABSTRACT

A display system includes a display panel comprising a plurality of pixel circuits, and a measurement and data processing unit that is external to the display panel. Each pixel circuit includes a light-emitting device having a first terminal connected to a first voltage supply and a second terminal opposite from the first terminal; a first transistor connected between a data voltage supply line from the measurement and data processing unit and the second terminal of the light emitting device; and a second transistor connected between the second terminal of the light-emitting device and a sample line to the measurement and data processing unit. The measurement and data processing unit samples a measured voltage at the second terminal of the light-emitting device through the sample line and outputs a data voltage to the light-emitting device based on the measured voltage to compensate variations in properties of the light-emitting device.

15 Claims, 15 Drawing Sheets

(56) References Cited

U.S. PATENT DOCUMENTS

| | | | | |
|---|---|---|---|---|
| 2012/0081381 | A1 | 4/2012 | Kobayashi | |
| 2013/0050292 | A1 | 2/2013 | Mizukoshi | |
| 2014/0168037 | A1 | 6/2014 | Sakariya et al. | |
| 2015/0294626 | A1 | 10/2015 | Bi et al. | |
| 2016/0240144 | A1* | 8/2016 | Song | G09G 3/3233 |
| 2018/0005581 | A1* | 1/2018 | Kim | G09G 3/3275 |
| 2018/0144689 | A1 | 5/2018 | Hong et al. | |

OTHER PUBLICATIONS

Final Office Action for related U.S. Appl. No. 15/937,965 dated Apr. 17, 2020.

Restriction Requirement for related U.S. Appl. No. 15/937,965 dated Sep. 26, 2019.

* cited by examiner

METHOD OF OPERATING A PIXEL CIRCUIT USING DIRECT CHARGING AND THAT PERFORMS LIGHT-EMITTING DEVICE COMPENSATION

RELATED APPLICATIONS

This application is a divisional application of U.S. application Ser. No. 15/937,965 filed on Mar. 28, 2018, the content of which is incorporated herein by reference.

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

In many conventional configurations, the OLED in the sub-pixel of a display is driven by an analogue drive transistor (drive TFT), which is in series with the OLED. The amount of current supplied to the OLED is related to the voltage on the gate of the drive TFT. The gate voltage is normally stored on a capacitor. The drive TFT device characteristics may vary due to manufacture processes or stress and aging of the drive TFT during the device operation. Accordingly, even if the gate voltage is the same between two different drive TFTs, the amount of current delivered by the drive TFT to the OLED may vary by a large amount, causing an unwanted variation in the brightness of the OLED sub-pixel. In addition, OLED device characteristics may vary due to manufacture processes, stress and aging during the operation of the OLED. For example, the threshold voltage of the OLED for light emission may change. Conventional circuit configurations, therefore, often include elements that operate to compensate for at least some of these component variations to achieve an OLED display with more uniform brightness between sub-pixels.

Accordingly, there are various methods proposed to compensate the drive TFT and OLED variations. Normally, such methods use a circuit configuration having several transistors. The size required by many of these circuit configurations may not be suitable for high resolution (e.g. high pixels per inch or ppi) display applications, in which each subpixel must occupy only a small area.

Conventionally, an OLED is programmed either by current programming or voltage programming. An example of OLED programming is a charge-based programming method, such as disclosed for example in U.S. Pat. No. 5,714,968 (Ikeda, issued Feb. 3, 1998), which uses one digital switch transistor and one storage capacitor. In such configuration and method, the transistor is connected to a data voltage line. When a control signal is applied to the gate of the transistor corresponding to the on state, the data voltage is applied to an OLED device through the transistor, and also to the storage capacitor connected in parallel with the OLED device. With application of the data voltage, the OLED begins to emit light while the capacitor is charged. When the gate voltage is switched to place the transistor in the off state, the data voltage is disconnected, but the capacitor continues discharging through OLED. The OLED, therefore, continues emitting light until the voltage from the capacitor charge is below the threshold voltage of the OLED.

Such a configuration that operates by charge-based programming lacks the analogue drive transistor of other conventional configurations, and thus variations of drive transistor properties will not be applicable to performance. Conventional charge-based programming configurations such as described above, however, do not compensate the OLED variations. In addition, conventional charge-based programming configurations employ a constant or bias current source applied to the OLED. This type of current source may be difficult to realize in practice when the current source must supply the current to a large number of sub-pixels in a column, such as in a display device. In particular for low current circumstances or applications, the drive speed could be detrimentally slow.

SUMMARY OF INVENTION

The present invention relates to pixel circuits that employ charge-based programming configurations that eliminate the need for a drive transistor, and also are capable of compensating for variations in the properties of the OLED, including the OLED threshold voltage for light emission. The described circuit configurations employ an external compensation system and methods to compensate for the OLED device variations.

In embodiments of the present invention, a data voltage is applied directly on the OLED anode, and a charge is stored on a storage capacitor constituting the internal capacitance of the OLED, and optionally a separate storage capacitor connected in parallel with the OLED. Application of the data voltage drives the OLED to emit light and charges the capacitor. When the data voltage is disconnected from the OLED anode, the OLED continues to emit light as the storage capacitor discharges until the voltage on the storage capacitor drops to the OLED threshold voltage. The OLED threshold voltage is the minimum voltage across the OLED for which the current passed by the OLED is above a particular value for light emission.

The disclosed configurations compensate any variation in the OLED properties using an external compensation system by which the applied data voltage is adjusted based on measurements of the OLED properties. In particular, the external compensation system measures the storage capacitance in the OLED pixel circuit, which includes the OLED internal capacitance $C_{OLED}$ and, optionally, the capacitance of a separate storage capacitor $C_{st}$. The external compensation system further measures threshold voltage variations of the OLED, and adjusts a data voltage so as to compensate for any such variations.

Circuit configurations in accordance with the present disclosure have advantages over conventional configurations. The charge-based programming configurations and methods enable programming data and light emission without requiring a drive TFT, i.e. there is no drive TFT operating in an analogue mode to control the current delivered to the OLED. This removes the deleterious effects of variations in drive TFT characteristics. In addition, unlike conventional charge-based programming configurations, the configurations and methods of the present disclosure compensate for variations in OLED characteristics, including OLED threshold voltage.

An aspect of the invention, therefore, is a display system that employs charge programming and can also compensate for variations in properties of the light emitting device. In exemplary embodiments, the display system includes a display panel comprising a plurality of pixel circuits, and a measurement and data processing unit that is external to the display panel. Each pixel circuit includes a light-emitting device having a first terminal connected to a first voltage supply and a second terminal opposite from the first terminal; a first transistor connected between a data voltage supply line from the measurement and data processing unit and the second terminal of the light emitting device; and a second transistor connected between the second terminal of the light-emitting device and a sample line to the measurement and data processing unit. The measurement and data processing unit is configured to sample a measured voltage at the second terminal of the light-emitting device through the sample line and to output a data voltage to the light-emitting device based on the measured voltage to compensate variations in properties of the light-emitting device. Each pixel circuit further may include a storage capacitor connected between the second terminal of the light-emitting device and a second voltage supply, wherein the storage capacitor discharges through the light-emitting device when the data voltage is disconnected from the pixel circuit.

In exemplary embodiments, the measurement and data processing unit may include a measurement unit, such as an analogue-to-digital converter, that converts the measured voltage to a digital value; a computation unit, such as a digital operator, that computes an output data voltage value based on the digital value and a target voltage data value; and an output unit, such as a digital-to-analogue converter, that converts the output data voltage value into an analogue data voltage that is outputted to the light-emitting device. The measurement and data processing unit further may include a memory cell that stores the digital value of the measured voltage, wherein the digital operator obtains the digital value from the memory cell.

Another aspect of the invention is a method of operating a pixel circuit that employs charge programming and compensates for variations in properties of the light-emitting device of the pixel circuit. In exemplary embodiments, the method includes the steps of: operating the pixel circuit in a measurement phase to compensate for variations in properties of a light-emitting device in the pixel circuit, the measurement phase comprising the steps of: operating the pixel circuit in a first measurement charge phase, wherein a first data voltage is applied to the pixel circuit to charge a capacitance of the pixel circuit; operating the pixel circuit in a measurement discharge phase to discharge the capacitance of the pixel circuit; operating the pixel circuit in a sampling phase, wherein one or more voltages at the light-emitting device at the end of the measurement discharge phase is measured on a sample line; and operating the pixel circuit in a second measurement charge phase by applying a second data voltage to the pixel circuit, wherein the second data voltage is adjusted relative to the first data voltage based on the voltage measured at the end of the measurement discharge phase to compensate for property variations of the light-emitting device. The method further includes operating the pixel circuit in an emission phase, wherein an emission data voltage is applied to the light emitting device for the emission of light based on the compensating performed during the measurement phase. The method further includes, based on the one or more voltages measured during the sampling phase, calculating a capacitance of the pixel circuit and a threshold voltage of the light emitting device, wherein variations in capacitance of the pixel circuit and/or threshold voltage of the light-emitting device are compensated.

The emission phase may include an emission charge phase during which the emission data voltage is applied to the pixel circuit, and the light-emitting device emits light and the capacitance of the pixel circuit is charged; and an emission discharge phase, wherein the emission data voltage is disconnected from the pixel circuit, and the capacitance of the pixel circuit discharges through the light-emitting device such that the light-emitting device continues to emit light.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
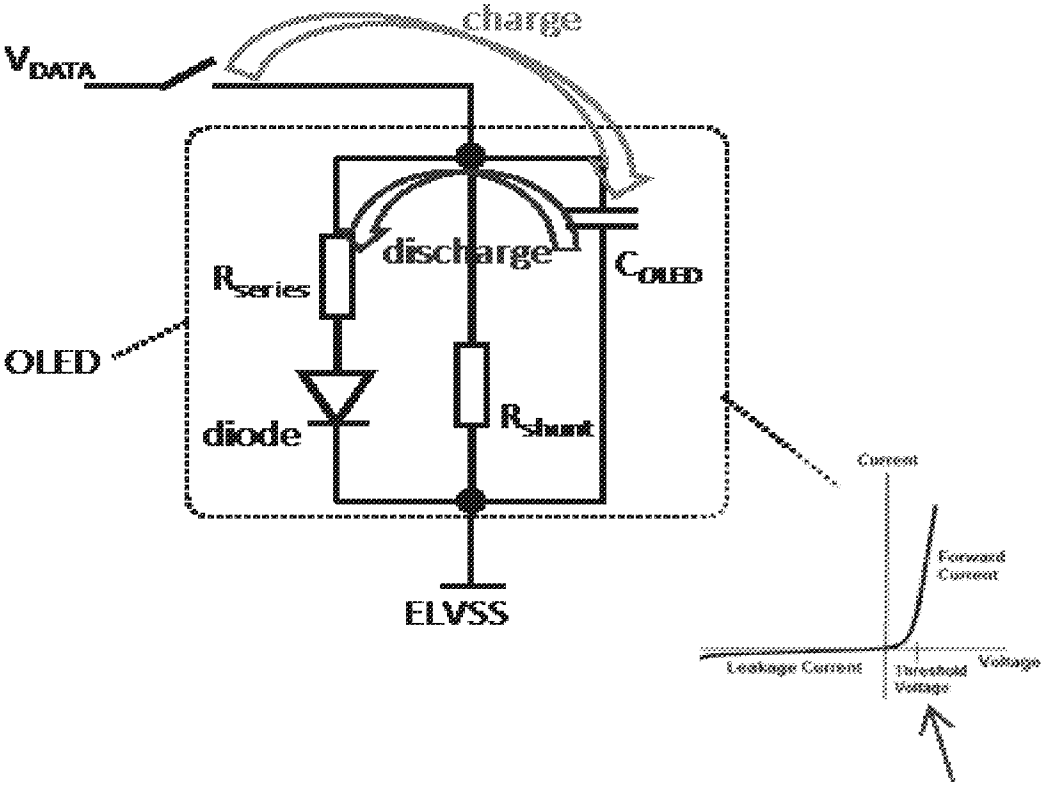
FIG. 1 is a drawing that illustrates the charge/discharge concept for an example OLED in which the storage capacitor is the internal capacitance of the OLED.

Embodiments of the present invention will now be described with reference to the drawings, wherein like reference numerals are used to refer to like elements throughout. It will be understood that the figures are not necessarily to scale.

The present invention employs pixel circuits that use charge-based programming configurations that eliminate the need for a drive transistor (TFT), and also are capable of compensating for variations in the properties of the OLED, including the OLED threshold voltage for light emission. The OLED threshold voltage generally is the minimum voltage across the OLED for which the current passed by the OLED is above a particular value for light emission. In a charge programming configuration, the total light energy output (L) is proportional to the total charge (Q) delivered to the OLED, which is equal to the current through the OLED (I) multiplied by the emission time (t):

$$L=k\cdot(I\cdot t)=kQ$$

where k is a constant of proportionality.

In conventional approaches to driving an OLED, a constant current is applied to the OLED for a certain time to achieve the target charge and therefore target light energy output. In contrast, in embodiments described in the present disclosure, the total charge is stored in a capacitor, which may include the internal capacitance of the OLED, and the capacitor discharges through the light-emitting diode of the OLED. The total charge delivered to the OLED can also be expressed as:

$$Q=C\cdot\Delta V=L/k$$

where C is the capacitance of the storage capacitor, and ΔV is the voltage level change across the capacitor. If a known amount of charge is stored in the storage capacitor and discharged through OLED during a frame time, the total light output L is controlled. A uniform luminance display can be achieved.

Figure 2:
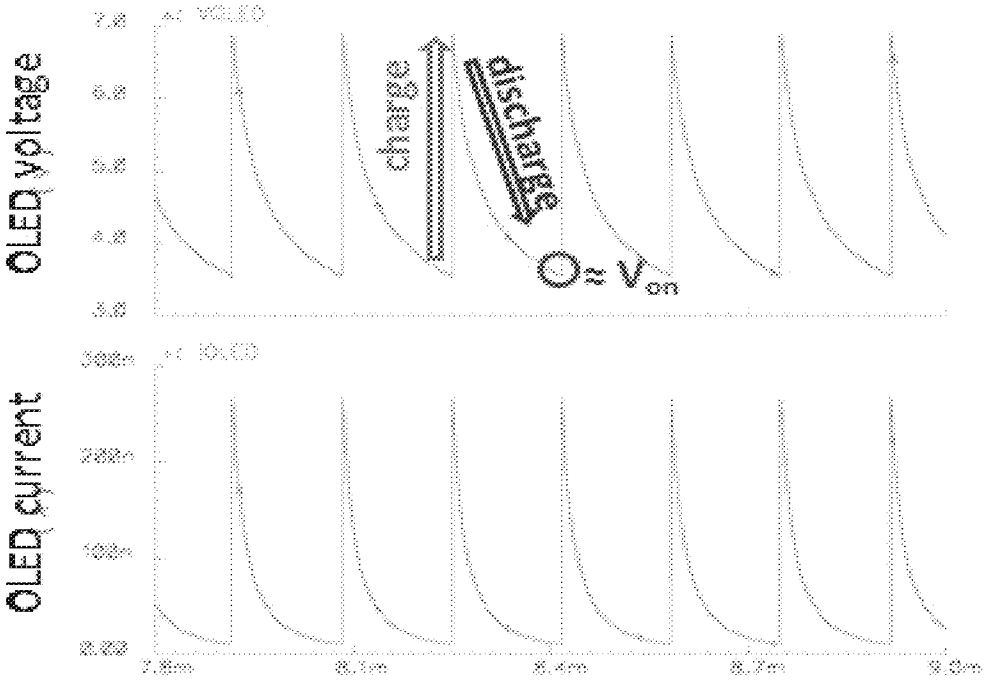
FIG. 2 shows the corresponding voltage and current at the OLED during charge and discharge that occurs in the example OLED of FIG. 1.

FIG. 1 is a drawing that illustrates the charge/discharge concept for an example OLED in which the storage capacitor is the internal capacitance $C_{OLED}$ of the OLED, i.e. the storage capacitor is not a separate component. FIG. 2 shows the corresponding voltage and current at the OLED during charge and discharge that occurs in the example OLED of FIG. 1. When the voltage VDATA is applied, current flows through the OLED, and the OLED emits light when the voltage across the OLED exceeds the threshold voltage. As referenced above, the OLED threshold voltage is the minimum voltage across the OLED for which the current passed through the OLED is above a particular value for light emission. The current through the OLED may be controlled through the presence of the internal resistors, $R_{series}$ and $R_{shunt}$. During operation, the applied voltage charges $C_{OLED}$. When the voltage $V_{DATA}$ is disconnected, the charge that has built up on $C_{OLED}$ discharges through $R_{series}$ to the light-emitting diode portion of the OLED, and the OLED will continue to emit light until the voltage across the OLED falls below the threshold voltage. As the voltage across the OLED reaches the threshold voltage, $V_{DATA}$ may be re-connected to enter a next charging phase, and charge-discharge cycles may be repeated as shown in FIG. 2 to achieve the desired OLED continuous light output.

Figure 3:
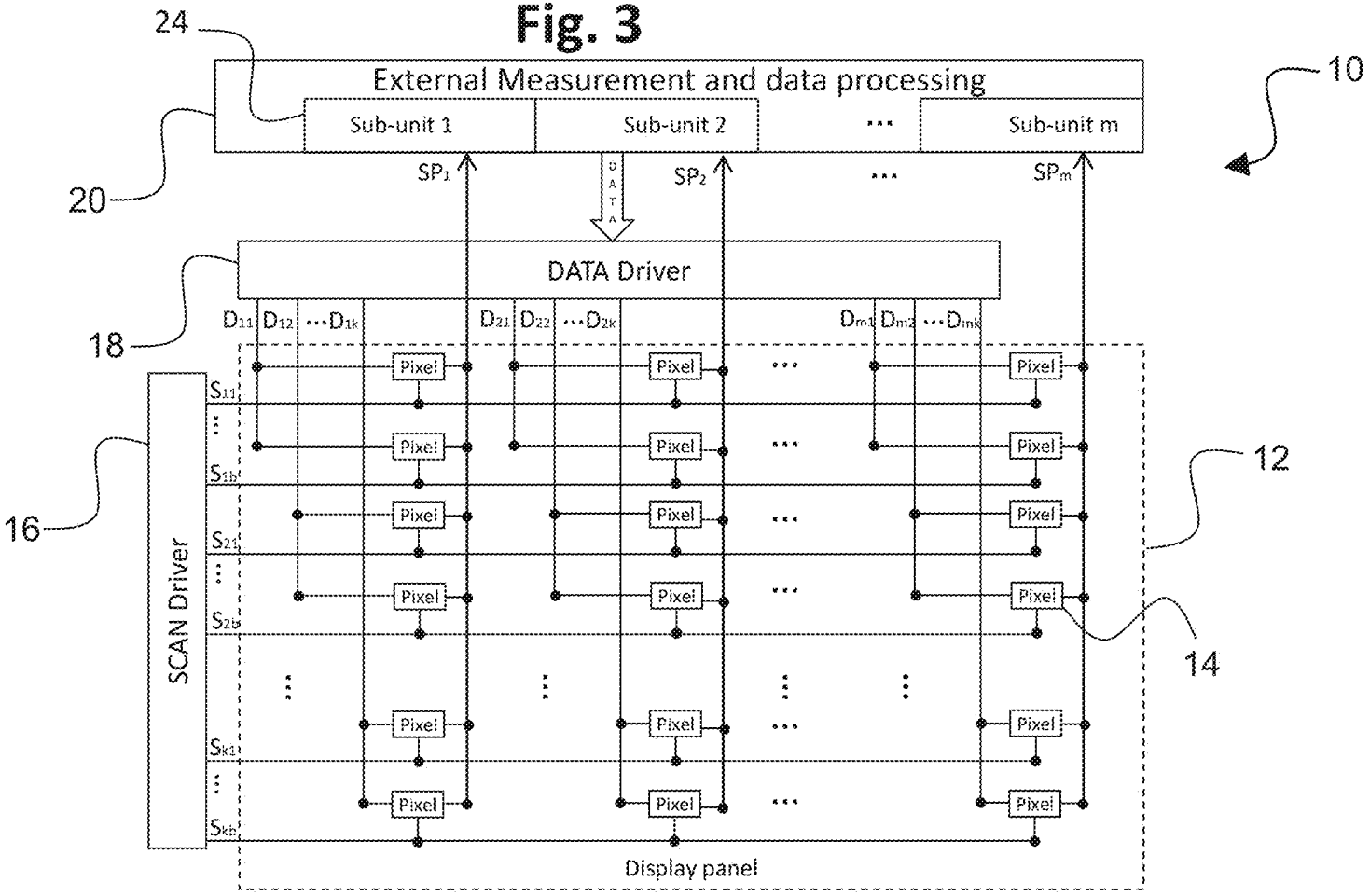
FIG. 3 is a block diagram depicting an exemplary display system in accordance with embodiments of the present invention.

FIG. 3 is a block diagram depicting an exemplary display system 10 in accordance with embodiments of the present invention. The display system 10 includes a display panel 12 comprising an array of pixels 14, a SCAN driver 16, a data driver 18, and an external measurement and data processing unit 20 comprising m column sub-unit 24. Each pixel includes an emissive light-emitting device, such as an OLED or other suitable light-emitting device like a micro-LED or quantum dot LED.

The time period through the completion of a data programming phase is referred to in the art as the "horizontal time" or "1H". A short 1H time is a requirement for displays with a large number of pixels in a column, as is necessary for high-resolution displays. For all the columns, the data can be loaded to one row from the data driver 18 during one horizontal time. For example, for a row number i, when a SCAN signal from the SCAN driver 16 enables this row, the DATA for each column (1 to m) can be loaded into each pixel in row i at the same time from the data driver 18. Rows may be programmed in sequence, and the number of rows that can be programmed depends on the scan frequency and the horizontal time. For example, for a scan frequency $f_{scan}$, the maximum number of rows that can be programmed is $$b=\frac{1}{f_{scan}\cdot 1H}.$$

In general, there may be more than one data line per column; specifically, there may be k data lines per column. Therefore, the rows can be segmented into k sections, and each section has b rows. In this manner, the total number of rows that can be programmed is increased to k·b.

The external measurement and data processing unit 20 includes m column sub unit 24 to perform the OLED compensation operations, as further detailed below. As used herein, the term "external" refers to the measurement and data processing unit 20 being external relative to the display panel 12 having the pixel circuitry for the array of pixels 14. In this manner, the size of the pixel circuitry associated with each individual pixel is minimized so as to permit a high-resolution display.

Generally, in embodiments of the present invention, a data voltage is applied directly on the OLED anode, and a charge is stored on a storage capacitor, which may include the internal capacitance of the OLED and optionally and additional separate storage capacitor Cst connected in parallel with the OLED. Application of the data voltage drives the OLED to emit light. When the data voltage is disconnected from the OLED anode, the OLED continues to emit light as the OLED capacitance and storage capacitor discharges until the stored voltage on the capacitors drops to the OLED threshold voltage. In addition, although the embodiments are described principally in connection with an OLED as the light-emitting device, comparable principles may be used with display technologies that employ other types of light-emitting devices, including for example micro LEDs and quantum dot LEDs.

The disclosed configurations compensate any variation in the OLED properties using an external compensation system by which the applied data voltage is adjusted based on measurements of the OLED properties. In particular, the external compensation system measures the storage capacitance in the OLED, which includes the OLED internal capacitance $C_{OLED}$ and, optionally, capacitance of the separate storage capacitor $C_{st}$. The external compensation system further measures threshold voltage variations of the OLED, and adjusts a data voltage so as to compensate for any such variations.

An aspect of the invention, therefore is a display system that employs charge programming and can also compensate for variations in properties of the light emitting device. In exemplary embodiments, the display system includes a display panel comprising a plurality of pixel circuits, and a measurement and data processing unit that is external to the display panel. Each pixel circuit includes a light-emitting device having a first terminal connected to a first voltage supply and a second terminal opposite from the first terminal; a first transistor connected between a data voltage supply line from the measurement and data processing unit and the second terminal of the light emitting device; and a second transistor connected between the second terminal of the light-emitting device and a sample line to the measurement and data processing unit. The measurement and data processing unit is configured to sample a measured voltage at the second terminal of the light-emitting device through the sample line and to output a data voltage to the light-emitting device based on the measured voltage to compensate variations in properties of the light-emitting device.

Figure 4:
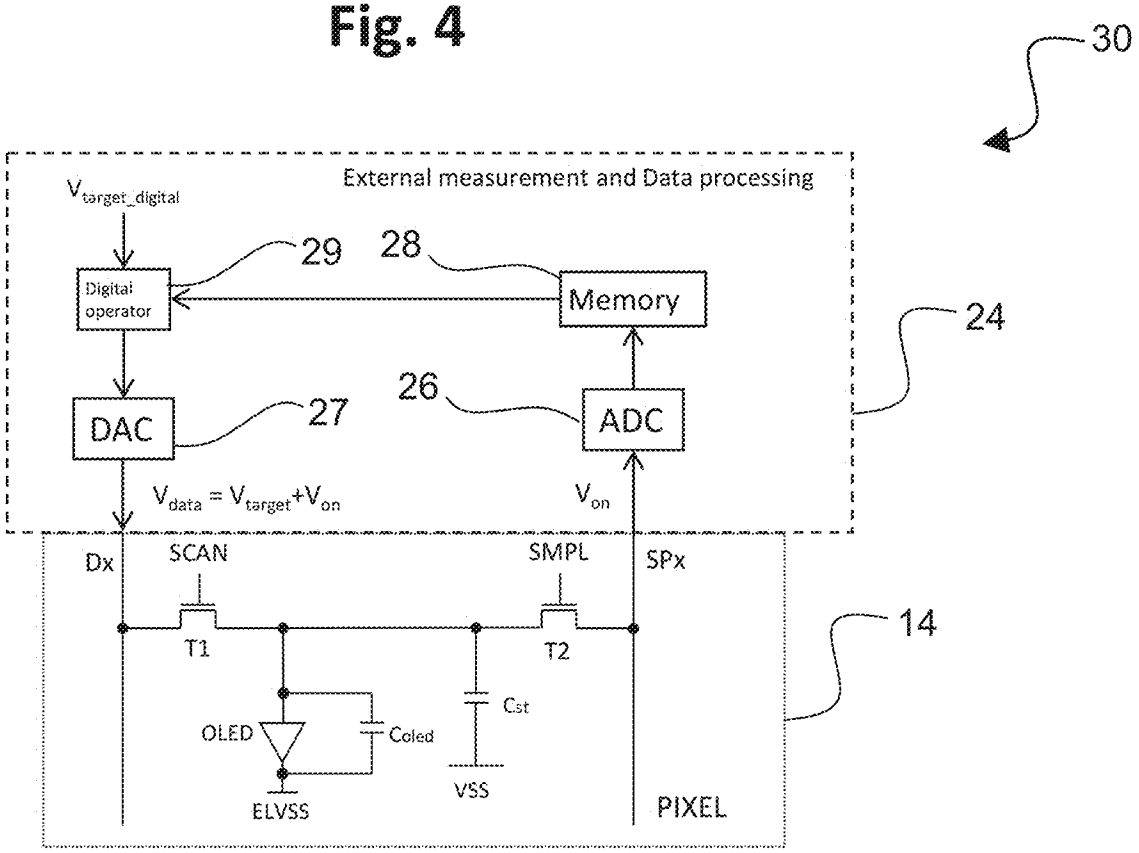
FIG. 4 is a drawing depicting a first circuit configuration in accordance with embodiments of the present invention.

FIG. 4 is a drawing depicting a first circuit configuration 30 in accordance with embodiments of the present invention. The circuit configuration 30 includes a pixel circuit 14 and a measurement and data processing sub-unit 24 that is external from the pixel circuit 14. Again, an advantage of an external measurement and data processing unit is that the pixel circuit size is minimized. In this regard, FIG. 4 shows only one pixel with the external measurement and data processing sub-unit 24. The actual connections between pixels and the external measurement and data processing sub-unit 24 are for all the pixels in one column.

The actual connections between pixels and the external measurement and data processing unit 20 are for "m" column and "k·b" rows of pixels, as shown for example in the system of FIG. 3, and thus the external measurement and data processing unit performs compensation operations for all pixels.

In this example, the pixel circuit 14 is configured as a TFT circuit including two switch transistors, TFTs T1 and T2, and one storage capacitor Cst. The bottom plate of the storage capacitor Cst is connected to a second voltage supply VSS. The on/off state of T1 is controlled by a SCAN signal, and the on/off state of T2 is controlled by a sampling signal SMPL. These signals are produced by the SCAN driver 16 of FIG. 3. The pixel circuit in FIG. 4 is illustrated as using n-type TFTs, but the pixel circuit could alternatively be realized using p-type TFTs. The pixel circuit further includes a light-emitting device, such as for example an OLED. The light-emitting device (OLED) has an associated internal capacitance, which is represented in the circuit diagram as $C_{oled}$ (i.e., $C_{oled}$ is not a separate component, but is inherent to the OLED). The OLED further is connected to a power supply ELVSS as is conventional. In exemplary embodiments, a first terminal of the OLED connected to ELVSS is the cathode, and a second terminal of the OLED that is connected to the transistors T1 and T2 is the anode, such that the data voltage is applied directly on the OLED anode.

In addition, although the embodiments are described principally in connection with an OLED as the light-emitting device, comparable principles may be used with display technologies that employ other types of light-emitting devices, including for example micro LEDs and quantum dot LEDs. In another example, the anode of the OLED could be connected to a power supply VDD and the cathode of the OLED can be connected to the transistor T1 and T2.

The OLED and the TFT pixel circuit 14, including the transistors, capacitors and connecting wires, may be fabricated using TFT fabrication processes conventional in the art. It will be appreciated that comparable fabrication processes may be employed to fabricate the pixel circuits according to any of the embodiments.

For example, the pixel circuit 14 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitor may comprise a first electrode, an insulating layer and a second electrode, whereby the insulating layer forms an insulating barrier between the first and second electrodes. Wiring between components in the circuit, and wiring used to introduce signals to the circuit may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistors T1 and T2 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power supply ELVSS in this example. The injection layers, transport layers and emission layer may be organic materials, the first and second electrodes may be metals, and all of these layers may be deposited by a thermal evaporation technique.

In exemplary embodiments, the measurement and data processing unit may include a measurement unit, such as an analogue-to-digital converter, that measures a sample voltage and converts the measured voltage to a digital value; a computation unit, such as a digital operator, that computes an output data voltage value based on the digital value and a target voltage data value; and an output unit, such as a digital-to-analogue converter, that converts the output data voltage value into an analogue data voltage that is outputted to the light-emitting device. The measurement and data processing unit further may include a memory cell that stores the digital value of the measured voltage, wherein the digital operator obtains the digital value from the memory cell.

Referring to the example of FIG. 4, the external measurement and data processing unit 24 includes a measurement unit configured as an analogue-to-digital converter (ADC) 26, which samples an analogue voltage on a sensing column line SPx that acts as a sample line, whereby "x" refers to a column to be sampled. The ADC 26 converts the sampled analogue voltage obtained from the sample line SPx to digital value or values indicating properties of the pixel. Those digital values are stored in a memory cell 28. The unit 24 further includes a computation unit configured as a digital operator 29, which uses an algorithm to combine the values stored in the memory cell 28 and the desired data value, i.e., a greyscale value of the OLED output, to generate a digital data value. The unit 24 further includes an output unit configured as a digital-to-analogue converter (DAC) 27, which converts this digital data value to an analogue data value, $V_{data}$ The analogue data value, $V_{data}$, is loaded to the pixel circuit 14 for light emission by the OLED. Generally, therefore, referring also to the display diagram of FIG. 3, the "m" column sampled data, SPx (or $SP_{1-m}$ for columns 1 to m), will be sampled by an ADC, and a DAC will supply "m" column voltage data Vdata to apply data to each pixel ($D_{m1}$ to $D_{mkb}$) in the column.

Figure 5:
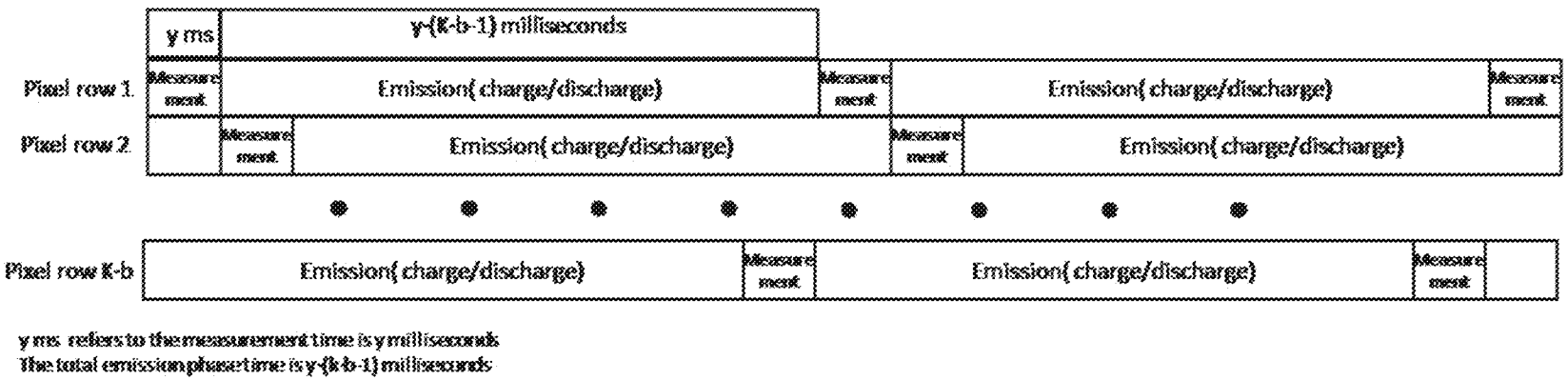
FIG. 5 is a timing diagram for whole frame sample and emission timing, such as for the display system of FIG. 3

FIG. 5 is a timing diagram for whole frame sample and emission timing, such as for the display device of FIG. 3, including the full array of pixels. The overall system operates in two main phases: an emission phase during which light is emitted, and a measurement phase during which OLED property variations are measured. FIG. 5 illustrates the timing for an entire measurement frame, which includes measurement and emission phases from the first row (row 1) to the last row (row k*b). The timing for successive rows occurs whereby a measurement phase for a next row begins upon completion of the measurement phase (and beginning the emission phase) for a previous row, until the frame is complete.

Generally, during the emission phase, each pixel is operated in a charge phase or a discharge phase. During the emission phase the light required from the pixel based on the desired greyscale level for each frame is generated. During the measurement phase, the pixel is operated in a charge phase, a discharge phase, or a sample phase. During the measurement phase, the OLED threshold voltage $V_{on}$ and the total capacitance $C_{Total}=C_{OLED}+C_{st}$ are measured. If the only capacitance is the internal OLED capacitance, then Cst is zero. The time to make a measurement may be in range of a few milliseconds, depending on the parasitic capacitance on the wiring, the ADC sampling time, and comparable factors relating to efficiency of operation. After the measurement phase, $V_{on}$ and $C_{Total}$ are known values for each pixel and are stored in the memory cell as values indicating properties of the pixel, based upon which compensation is performed by adjusting the data voltage value. Details as to each phase are described as follows.

Figure 6:
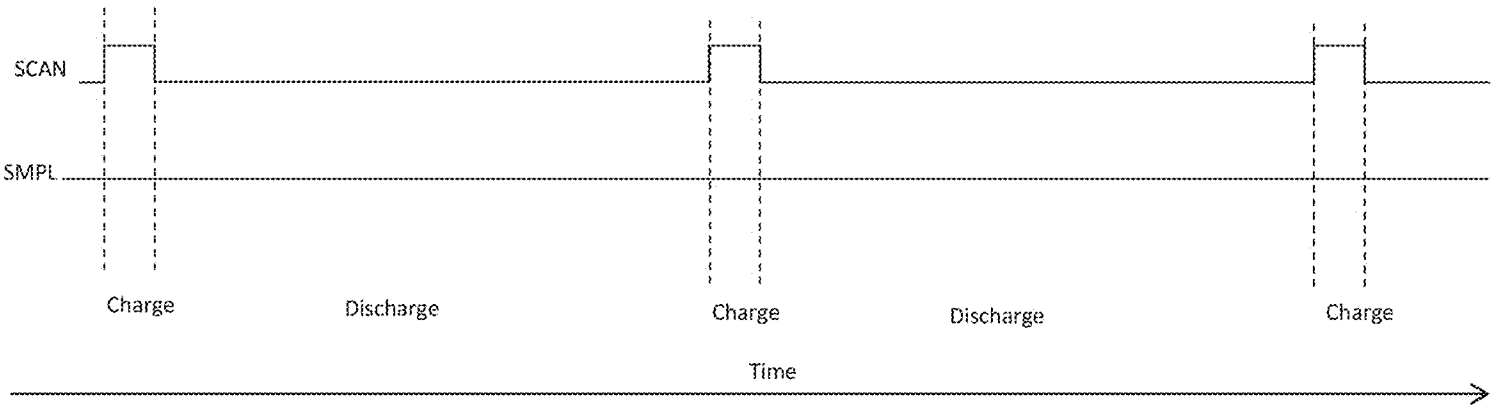
FIG. 6 is a timing diagram of an emission phase, utilizing the circuit configuration of FIG. 4 as a reference.

FIG. 6 is a timing diagram of an emission phase, utilizing the circuit configuration of FIG. 4 as a reference. Comparable operation may be performed as to any pixel in the array. The control signal SCAN is changed from low to high, causing transistor T1 in the pixel circuit to be turned on. This starts an emission charge phase, during which the data voltage $V_{data}$ is applied at the anode of the OLED and stored in capacitors $C_{OLED}$ and $C_{st}$. The OLED starts to emit light as $V_{DATA}$, associated with a desired greyscale value, is above the OLED threshold voltage. After a time interval denoted herein as $t_{charge}$, the control signal SCAN is changed from high to low, causing the transistor T1 to be turned off. This ends the emission charge phase and starts an emission discharge phase. At the end of the emission charge phase, the total stored charge on the capacitors is:

$$Q_{Start}=(V_{data}-\text{ELVSS})\cdot C_{OLED}+(V_{data}-\text{VSS})\cdot C_{st}$$

During the emission discharge phase, the OLED emits light as the stored charge on the capacitors $C_{OLED}$ and $C_{st}$ dissipates through the OLED. After a time interval denoted herein as $t_{discharge}$, the control signal SCAN is changed from low to high again, causing transistor T1 in the pixel circuit to be turned on, thereby initiating the next emission charge phase. Throughout the emission phase, the sample signal SMPL signal is kept low such that the transistor T2 is off so the sample line SPx is disconnected from the pixel circuit.

During the emission discharge phase, the OLED emits light as the stored charge on the capacitors $C_{OLED}$ and $C_{st}$ dissipates through the OLED. As a result, the voltage on the OLED anode falls. If the voltage on the OLED anode drops below the OLED threshold voltage, $V_{on}$, the OLED will stop emitting light. The voltage on the OLED anode at the end of the emission discharge phase, i.e. immediately before the start of the next charge phase, is denoted $V_{End}$. The stored charge at the end of emission discharge phase $Q_{End}$ is:

$$Q_{End}=(V_{End}-\text{ELVSS})\cdot C_{OLED}+(V_{End}-\text{VSS})C_{st}.$$

The total light energy output is proportional to the charge difference:

$$\Delta Q=(V_{data}-V_{End})\cdot(C_{OLED}+C_{st})$$

Preferably, the voltage on the OLED anode drops to the OLED threshold voltage before the end of the emission discharge phase such that $V_{End}\approx V_{on}$. In this case, the total light energy output is proportional to the charge difference:

$$\Delta Q=(V_{data}-V_{on})\cdot(C_{OLED}+C_{st})$$

Figure 7:
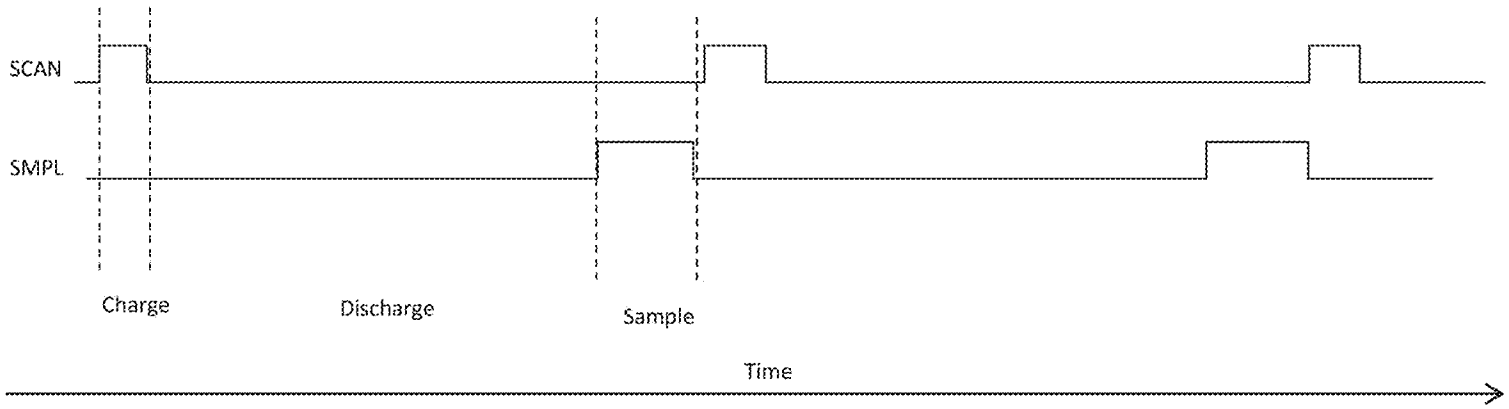
FIG. 7 is a timing diagram of a measurement phase, utilizing the circuit configuration of FIG. 4 as a reference.

FIG. 7 is a timing diagram of the measurement phase, again utilizing the circuit configuration of FIG. 4 as a reference. Again, comparable operation may be performed as to any pixel in the array. The control signal SCAN is changed from low to high, causing transistor T1 in the pixel to be turned on. This starts a first measurement charge phase. For purposes of the measurement phase, preferably the data voltage is low for the first measurement charge phase. A low data voltage charge phase will avoid bright light emission from the OLED, and is especially advantageous if the measurement phase is being carried out in real time while the display is showing an image. The data voltage should preferably be slightly higher than the OLED threshold voltage $V_{on}$, for example the data voltage is 1% higher than the last known or measured OLED threshold voltage. For the first time factory measurement, the data voltage will set to 1% above the highest OLED threshold voltage within the process variations. In another example, the data voltage is up to 100 mV higher than the last known or measured OLED threshold voltage or up to 100 mV above the highest OLED threshold voltage within the process variations. The data voltage is applied at the anode of the OLED and stored in capacitors $C_{OLED}$ and $C_{st}$.

After a time interval for the measurement charge phase denoted $t_{charge}$, the control signal SCAN is changed from high to low, causing the transistor T1 to be turned off. This ends the first measurement charge phase and starts the measurement discharge phase. During the measurement discharge phase, the OLED emits light (preferably a low light level) by discharging the charge on the capacitors $C_{OLED}$ and $C_{st}$. After a time interval for the measurement discharge phase denoted $t_{discharge}$, the control signal SMPL is changed from low to high, causing transistor T2 to be turned on to connect the sample line SPx to the OLED. This starts the sample phase, and a voltage at the anode of the OLED at the end of the measurement discharge phase, denoted, $V_{End}$, is sampled by the ADC. The control signal SMPL then is changed from high to low, causing transistor T2 to be turned off which ends the sample phase by disconnecting the sample line SPx from the OLED.

The control signal SCAN then is changed from low to high, causing transistor T1 in the pixel to be turned on. This starts a next or second measurement charge phase. Preferably, the voltage on the OLED anode drops to the OLED threshold voltage before the end of the measurement discharge phase such that $V_{End}\approx V_{on}$. Therefore, the OLED threshold voltage $V_{on}$ is measured as essentially being the same as $V_{End}$ at the end of the measurement discharge phase.

The external measurement and data processing unit 24 operate as follows to perform compensation of OLED properties. During the sample phase, the measured $V_{End} \approx V_{on}$ will be sampled and converted by the ADC 26 to a digital value. In the following discussion, it is assumed that $V_{End}=V_{on}$ as a close approximation, such that there is a measurement of the OLED threshold voltage for this pixel. The converted digital $V_{on}$ for this pixel is stored in the memory cell 28, or optionally $V_{on}$ data from more than one pixel of the display are compressed via a digital algorithm and stored in the memory cell 28 after data compression. When compensation is performed, $V_{on}$ for this pixel is read from the memory cell 28.

During the emission phase described above, there is a target greyscale (or brightness) value for a pixel. The following explains how this brightness value is achieved. The digital operator 29 combines the target greyscale value, denoted $V_{target_digital}$, with digital $V_{on}$ stored in the memory cell 28. This combined value will be converted by the DAC 27 to an analogue voltage $V_{data}$, wherein $V_{data}=V_{target}+V_{on}$. The analogue voltage will be applied to the OLED during the emission charge phase when SCAN line enables the transistor T1 for emission.

The target greyscale value $V_{target_digital}$ may be set in the following way. The luminance of the pixel is set by the following equation:

$$L_p=k\cdot f_{scan}(V_{data}-V_{on})\cdot(C_{OLED}+C_{st})$$

where k is a charge to light conversion constant, which is an experimentally determined value as is known in the art for a particular pixel or a typical parameter for the OLED device. $f_{scan}$ is the frequency of the control signal SCAN, i.e. the reciprocal of the period between SCAN rising from low to high. The luminance $L_p$ can be changed by applying different $V_{data}$ or changing the frequency of $f_{scan}$. Preferably, $f_{scan}$ is used to set the global luminance and thus would remain constant for device operation. For a given or set global luminance, the $V_{data}$ then is used to set the different grayscale values of the light output. With the external measurement by the unit 24, as referenced above $V_{data}=V_{target}+V_{on}$. Accordingly, the luminance after external measurement is:

$$L_p k\cdot f_{scan}(V_{target}+V_{on}-V_{on})\cdot(C_{OLED}+C_{st})=k\cdot f_{scan}\cdot V_{target}\cdot(C_{OLED}+C_{st})$$

As evident form the above expression, the luminance does not depend on OLED or transistor threshold voltage characteristics. Variations are therefore compensated, and a uniform display can be achieved. During the second measurement charge phase, there will some light output, but if such charge phase is short enough as shown in FIG. 7, the light output error will be sufficiently small to be indistinguishable to human eyes.

Circuit configurations in accordance with the present disclosure have advantages over conventional configurations. The charge-based programming configurations and methods enable programming data and light emission without requiring a drive TFT, i.e. there is no drive TFT operating in an analogue mode to control the current delivered to the OLED. This removes the deleterious effects of variations in drive TFT characteristics. In addition, unlike conventional charge-based programming configurations, the configurations and methods of the present disclosure compensate for variations in OLED characteristics, including OLED threshold voltage and capacitance of the pixel circuit.

Figure 8:
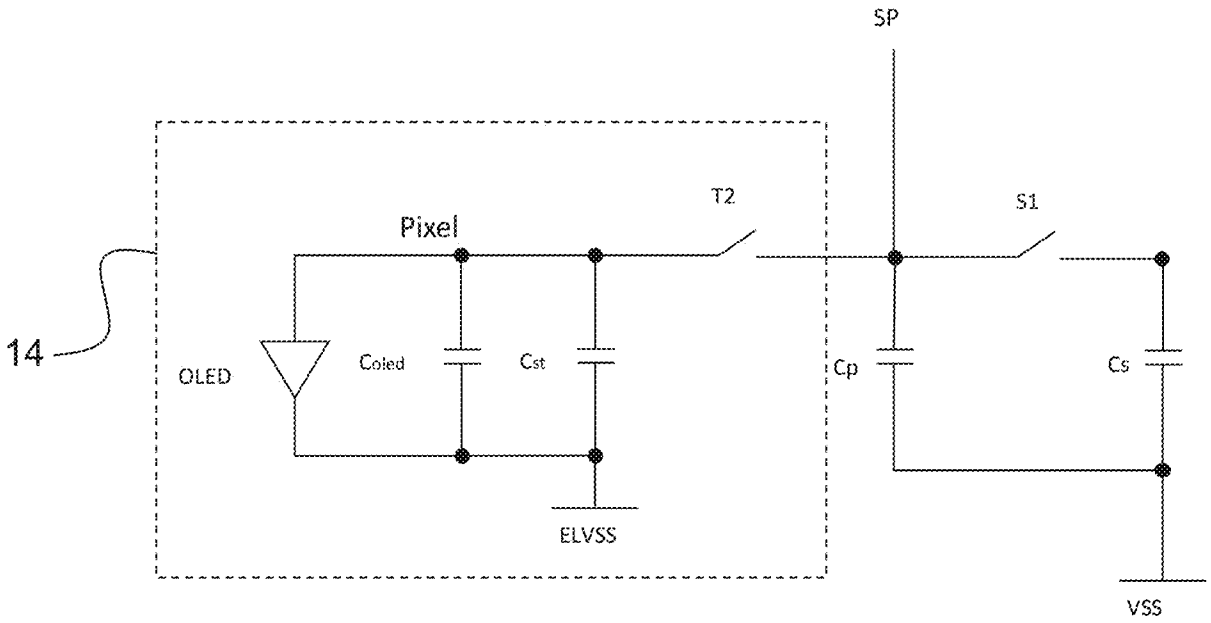
FIG. 8 is a drawing depicting a representation of a pixel circuit and external sample line during the sampling phase of the measurement phase.

Additional details regarding the measurements by the external measurement and data processing unit 24 from the sample line will now be described. FIG. 8 is a drawing depicting a representation of the pixel circuit 14 during the sampling phase of the measurement phase as described above. The measurements of the OLED threshold voltage $V_{on}$, and the pixel total capacitance, $C_{Total}=C_{OLED}+C_{st}$, are illustrated with reference to FIG. 8. FIG. 8 shows the circuit diagram during sampling of the sample line, whereby SP is the column sample line signal comparably as in previous figures (SPx for a given column); Cp is a parasitic capacitance on the sample line; Cs is a sampling capacitor incorporated on the sample line; and S1 is a switch, such as a switch transistor, incorporated on the sample line.

The external measurements may include two categories of measurements, denoted herein as an initial measurement and a real time measurement. The initial measurement takes longer time and generally would be performed as a factory calibration or when the device is in a standby mode. The initial measurement will measure the $V_{on}$ and $C_{OLED}$ for compensation of property variations of the OLED. As the $C_{OLED}$ mismatch between pixels typically does not change, the initial measurement that is used to compensate for any $C_{OLED}$ variations needs only to be performed once, or at least infrequently, and thus as referenced above may be performed as part of a factory calibration or in a standby mode. Real time measurements may be performed in a standby mode. However, the OLED threshold voltage as represented by $V_{on}$ can vary over time and usage of the OLED. Accordingly, the real time measurements may be employed repeatedly to refresh the threshold voltage in real time for purposes of OLED voltage threshold compensation.

Timing aspects associated with the measurement phase were described above with reference to FIG. 7. A low data voltage is applied during the measurement charge phase. At the end of the measurement discharge phase, the transistor T2 is turned on, and the OLED threshold voltage $V_{on}$ will be sampled and measured. For simplicity, if assuming ELVSS=VSS=0, the charge at the pixel capacitors is $(C_{OLED}+C_{st})\cdot V_{on}$.

The steps of the initial measurement category of external measurements proceeds as follows. Referring additionally to FIG. 8, prior to turning on the transistor T2, a charge on the parasitic capacitor Cp in the sample line is reset by setting a voltage, denoted first reset voltage $V_1$, on the sample line SP. The $V_1$ should be lower than the threshold voltage of OLED to avoid causing light emission or losing charge during the sample phase. When such reset is performed before transistor T2 is turned on, when the transistor T2 subsequently is turned on the charge will distribute between Coled+Cst and Cp as follows:

$$V_1\cdot C_p+(C_{OLED}+C_{st})\cdot V_{on}\cdot(C_{OLED}+C_{st}+C_p)\cdot V_{m0}$$

Four voltages are then measured as part of the initial measurement from the sample line. The first measurement voltage is an initial voltage on the sample, $V_{m0}$, which is:

$$V_{m0}=\frac{C_{OLED}+C_{st}}{C_{OLED}+C_{st}+C_p}\cdot V_{on}+\frac{V_1\cdot C_p}{C_{OLED}+C_{st}+C_p}$$

The second measurement voltage is obtained by repeating the above steps "n" times, while not resetting the Cp. The final measurement $V_{mf}$ will settle to $V_{on}$ as follows:

$$V_{mf} = V_{on} \cdot \left(1 - \left(\frac{C_p}{C_{OLED} + C_{st} + C_p}\right)^n\right) + V_1 \cdot \left(\frac{C_p}{C_{OLED} + C_{st} + C_p}\right)^n \approx V_{on}$$

Accordingly, at the end of the iterations the OLED threshold voltage $V_{on}$ will be a known value $V_{mf}$. In the above process, the number of iterations, n, depends on the difference between the resetting voltage $V_1$ in the first measurement step and the parasitic capacitance $C_p$. If $V_1$ is close to $V_{on}$ and the parasitic capacitance is small, and only a small number of iterations will be needed to obtain $V_{mf}$. For example, in such case as few as five iterations will be sufficient. In more typical scenarios, the parasitic capacitance on the sample line could be large and thus 20-30 iterations would be performed. Generally, the number of the iterations, n, can be decided during measurement. The iterations could terminate when a difference between the two consecutive iteration measurements, $V_{mf(n)}-V_{mf(n-1)}$, is below a predetermined amount so as to be small enough to accurately approximate $V_{on}$. For example, the difference in successive iterations may be less than 1%, or for more accuracy less than 0.1%, for termination of the iterations.

The third measurement voltage, denoted $V_{m1}$, is obtained comparably as the first measurement voltage, with the parasitic capacitance Cp being reset to a different second reset voltage $V_2$ on the measurement line SP. Similarly, the $V_2$ should be lower than the threshold voltage of OLED to avoid causing light emission or losing charge during the sample phase. The third measurement voltage then is:

$$V_{m1} = \frac{C_{OLED} + C_{st}}{C_{OLED} + C_{st} + C_p} \cdot V_{on} + \frac{V_2 \cdot C_p}{C_{OLED} + C_{st} + C_p}$$

The fourth measurement voltage, denoted $V_{m2}$, then is obtained by resetting the parasitic capacitance Cp and the sampling capacitor Cs to the first reset voltage $V_1$, then turning on both transistor T2 and the sampling switch S1, thereby connecting all the capacitors' terminals together. With the switches T2 and S1 in the on state (closed), the fourth measurement voltage is:

$$V_{m2} = \frac{C_{OLED} + C_{st}}{C_{OLED} + C_{st} + C_p + C_s} \cdot V_{on} + \frac{V_1 \cdot (C_p + C_s)}{C_{OLED} + C_{st} + C_p + C_s}$$

With the above four equations for the four measurement voltages, the total capacitance of the pixel circuit $C_{OLED}+C_{st}$ can be determined:

$$C_{OLED} + C_{st} = \frac{C_s \cdot (V_{m2} - V_1)}{V_{m0} - V_{m2}}\left(1 - \frac{V_{m0} - V_{m1}}{V_1 - V_2}\right)$$

Since $C_{OLED}+C_{st}$ and $V_{on}$ are now known values, and the scan frequency $f_{scan}$ is set for a certain global luminance, the resultant $V_{data}$ now can be set as follows:

$$V_{data} = \frac{L_p}{f_{scan} \cdot k \cdot (C_{OLED} + C_{st})} + V_{on} = \frac{L_p \cdot (V_{m0} - V_{m2}) \cdot (V_1 - V_2)}{f_{scan} \cdot k \cdot C_s (V_{m2} - V_1) \cdot (V_1 - V_2 - V_{m0} + V_{m1})} + V_{mf}$$

where, $L_p$ is the luminance and k is a luminance to voltage conversion parameter. In this manner, the initial measurements are used to set the value of $V_{data}$ in accordance with the properties of the OLED. Again, as the initial measurements determine the total capacitance of the pixel circuit, $C_{OLED}+C_{st}$, and such capacitances generally do not change over time, the initial measurements may be performed only once (or infrequently) as part of a factory calibration or when the device is in a standby mode for setting a default $V_{data}$.

The real time measurements are employed to refresh the determination of the OLED threshold voltage $V_{on}$, which as stated above, unlike the capacitances, can vary over time. Accordingly, the real time measurements are repeated during the measurement period during operation of the pixel circuit. The determination of an appropriate $V_{on}$, was performed using the iterative process in measuring the second measurement voltage above, whereby at the end of the iterations, $V_{mf} \approx V_{on}$. Accordingly, the real time measurements correspond to the determination of the second measured voltage of the initial measurement process during actual operation of the device during the measurement phase.

Figure 9:
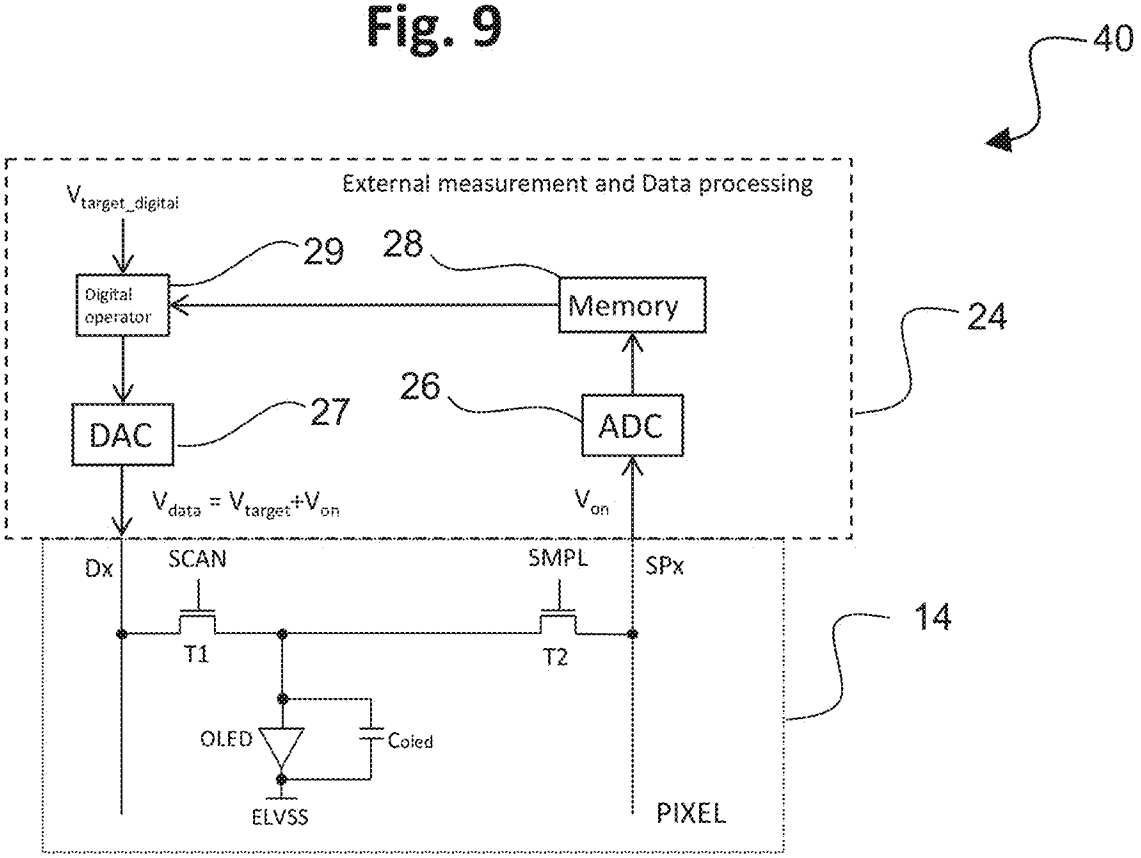
FIG. 9 is a drawing depicting a second circuit configuration in accordance with embodiments of the present invention.

FIG. 9 is a drawing depicting a second circuit configuration 40 in accordance with embodiments of the present invention. Like components in FIG. 9 are identified with like reference numerals as in FIG. 4, with the circuit differences being described below. In particular, in the embodiment of FIG. 9 there is no separate storage capacitor Cst. Such a configuration may be employed when the OLED has a larger size or scale, such that $C_{oled}$ is large enough to meet the maximum luminance requirements particularly during the emission discharge phase. Otherwise, the embodiment of FIG. 9 operates comparably as has been described with respect to the embodiment of FIG. 4. In the applicable equations, Cst=0, and the light output is:

$$L_p = k \cdot f_{scan}(V_{data} - V_{on}) \cdot C_{OLED}$$

Advantageously, since no separate storage capacitor is included in the backplane of the display to form Cst for the pixels, the overall size of the pixel circuits may be made smaller. Again, however, this smaller size is attainable when $C_{oled}$ is large enough to meet the maximum luminance requirements particularly during the emission discharge phase.

Figure 10:
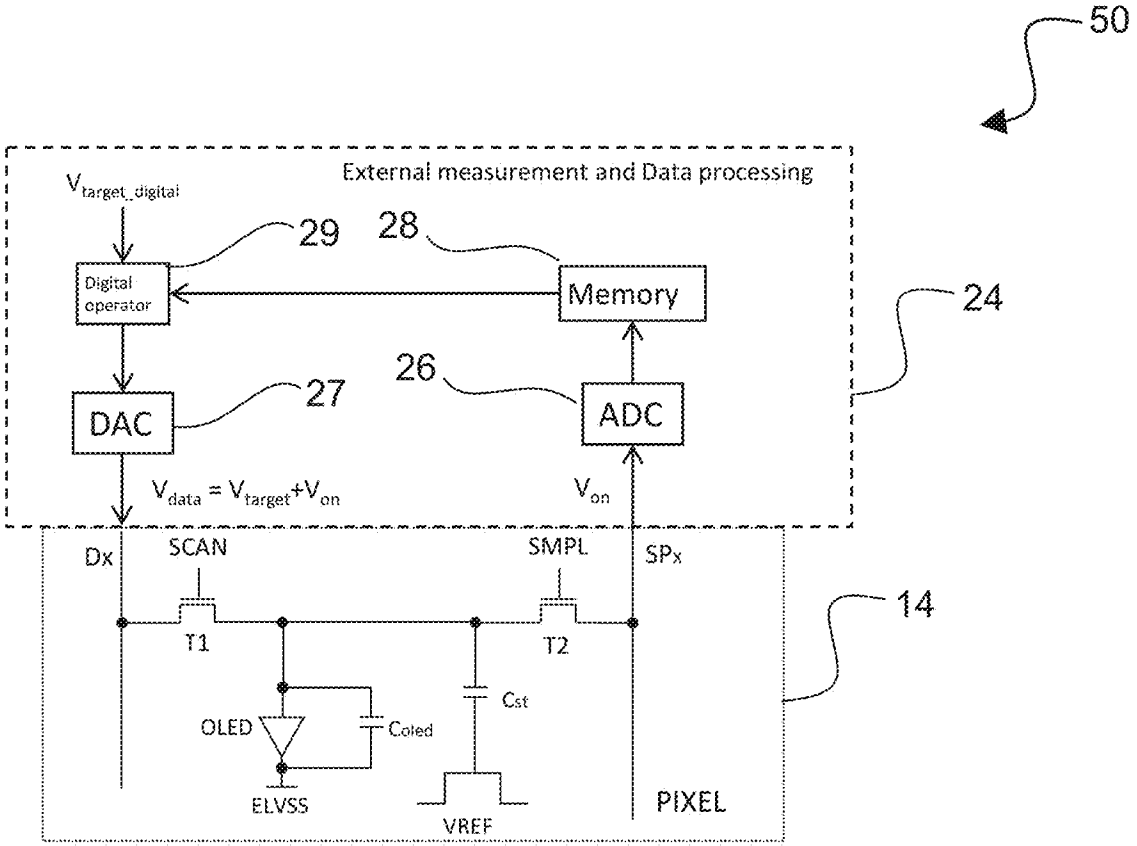
FIG. 10 is a drawing depicting a third circuit configuration in accordance with embodiments of the present invention.

FIG. 10 is a drawing depicting a third circuit configuration 50 in accordance with embodiments of the present invention. Like components in FIG. 10 are identified with like reference numerals as in FIGS. 4 and 9, with the circuit differences being described below. In particular, in the embodiment of FIG. 10 there is a multi-level boosting reference voltage VREF that is applied at the bottom plate of the storage capacitor Cst. This enables the use of smaller capacitors which results in a smaller pixel circuit and/or smaller frequencies $f_{scan}$ to obtain the requisite luminance.

Figure 11:
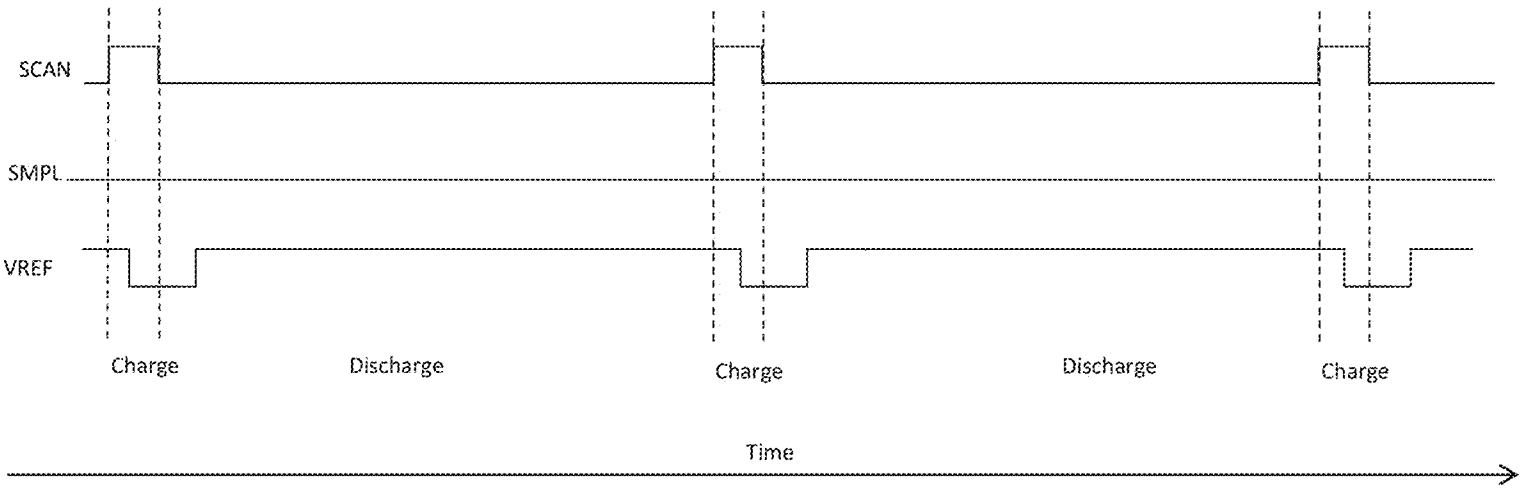
FIG. 11 is a timing diagram of an emission phase for the third circuit configuration of FIG. 10.

FIG. 11 is a timing diagram of an emission phase for the third circuit configuration 50 of FIG. 10 using the boost reference voltage VREF. Referring to FIGS. 10 and 11, the control signal SCAN is changed from low to high, causing the transistor T1 to be turned on. This starts the emission charge phase, and the data voltage $V_{data}$ is stored on capacitors $C_{OLED}$ and $C_{st}$. The reference voltage VREF is then changed from a high value to a low value, i.e., from $VH_{REF}$ to $VL_{REF}$, while the transistor T1 is turned on. After a time interval for charging denoted $t_{charge}$, the control signal SCAN is changed from high to low, causing transistor T1 to be turned off. This ends the emission charge phase and starts the emission discharge phase. At the end of the emission charge phase, the total stored charge is:

$$Q_{Start}=(V_{data}-\text{ELVSS})\cdot C_{OLED}+(V_{data}-VL_{REF})\cdot C_{st}.$$

During the emission discharge phase, the OLED emits light as the stored charge on the capacitors $C_{OLED}$ and $C_{st}$ dissipates through the OLED. The reference voltage VREF is changed from the low value to the high value, $VL_{REF}$ to $VH_{REF}$, during the emission discharge phase. After a time interval for discharging denoted $t_{discharge}$, the control signal SCAN is changed from low to high, causing transistor T1 in the pixel circuit to be turned on. This starts the next emission charge phase. During the emission discharge phase, the OLED anode voltage will preferably fall to approximately Von. The total charge stored at the end of emission discharge phase is:

$$Q_{End}=(V_{on}-\text{ELVSS})\cdot C_{OLED}+(V_{on}-VH_{REF})C_{st}.$$

The light energy output will be proportional to the charge difference:

$$\Delta Q=Q_{Start}-Q_{end}=(V_{data}-V_{on})\cdot C_{OLED}+(V_{data}-V_{on}+VH_{REF}-VL_{REF})\cdot C_{st}=(V_{data}-V_{on})\cdot C_{OLED}+(V_{data}-V_{on}+\Delta V_{REF})\cdot C_{st}$$

In this manner, compared to previous embodiments, the light output is boosted by $\Delta V_{REF}\cdot C_{st}$, where $\Delta V_{REF}$ is a difference between the high reference voltage value and the low reference voltage value. Accordingly, for a given desired light output, application of the reference voltage permits use of smaller capacitors to achieve the same light output.

In exemplary embodiments, a timing of the data writing may be optimized especially for low current applications. In low current applications, the threshold voltage compensation accuracy may be lower as compared to higher current applications. There are two main reasons for the reduced compensation accuracy at lower currents. First, if the scan speed is high, at the end of discharge phase it can occur that the charge has not been completely discharged. Any residual charge will introduce an error in a subsequent emission phase. This error may not be significant when the operation current is high, but may become significant when the operation current is low. Second, with low current, it could take a substantial time to completely discharge the capacitor which renders it more likely to introduce the referenced error by the presence of a residual charge.

Figure 12:
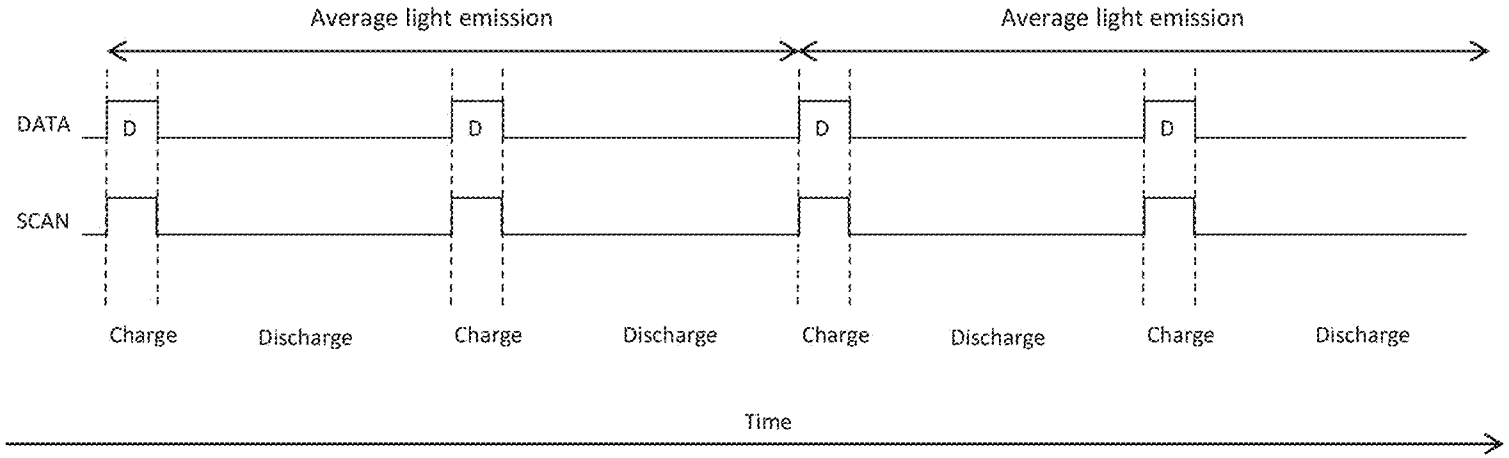
FIG. 12 is a timing diagram illustrating standard data writing.

FIG. 12 is a timing diagram illustrating standard data writing. The emission charge and discharge phases operate as previously described. In standard data writing, during each scan period, the DATA "D" will be written into the pixel. For low current, a low data value D will be programmed to the pixel, which has the propensity for error as referenced above.

Figure 13:
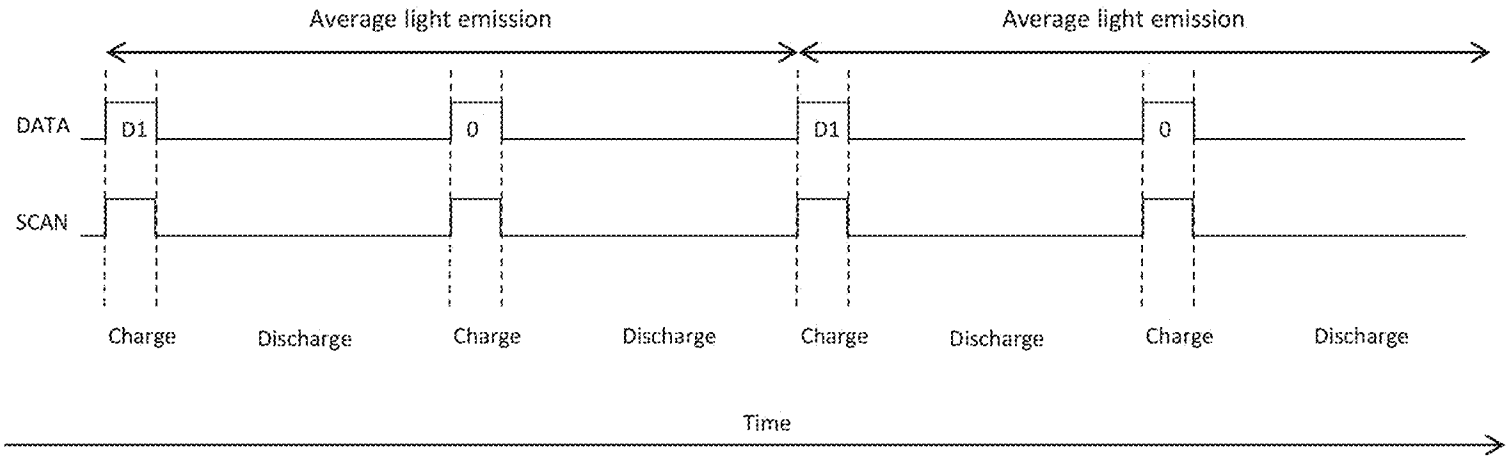
FIG. 13 is a timing diagram illustrating optimized data writing for low current operation in accordance with embodiments of the present invention.

FIG. 13 is a timing diagram illustrating optimized data writing for low current operation in accordance with embodiments of the present invention. In the operation of FIG. 13, a data "0", corresponding to a lowest analogue data value, can be inserted between the actual data value D1. D1 may be a higher data value that in the standard data writing because the data writing is interspersed with one or a number of "0" level data inputs, so as to maintain a comparable average light emission over the emission phase as in the standard data writing. Because of the larger data values D1, any potential errors become less significant. In addition, such operation effectively reduces the scan speed for a low current locally, while keeping the global scan speed fixed. Furthermore, at the end of emission discharge phase, any residual charge will be refreshed by data "0" to eliminate said residual charge. In this manner, the error resulting from variations caused by the residual charge are reduced.

The various embodiments have been described in connection with OLEDs as the display light-emitting device. The circuit configurations and operation methods, however, are not limited to any particular display technology. For example, the circuit configurations and methods also may also be used for micro LED displays, quantum dot LED displays, or any other device which emits light in response to an applied electrical bias. A micro LED, for example, is a semiconductor device containing a p-type region, an n-type region and a light emission region, for example formed on a substrate and divided into individual chips. A micro LED may be based on a III-nitride semiconductor. A quantum dot LED, for example, is a device containing a hole transport layer, an electron transport layer, and a light emission region, wherein the light emission regions contains nanocrystalline quantum dots. The circuit configurations, described herein may be employed for any such display technologies.

An aspect of the invention, therefore, is a display system that employs charge programming and can also compensate for variations in properties of the light emitting device. In exemplary embodiments, the display system includes a display panel comprising a plurality of pixel circuits, and a measurement and data processing unit that is external to the display panel. Each pixel circuit comprises: a light-emitting device having a first terminal connected to a first voltage supply and a second terminal opposite from the first terminal; a first transistor connected between a data voltage supply line from the measurement and data processing unit and the second terminal of the light emitting device; and a second transistor connected between the second terminal of the light-emitting device and a sample line to the measurement and data processing unit; wherein the measurement and data processing unit is configured to sample a measured voltage at the second terminal of the light-emitting device through the sample line, and to output a data voltage to the light-emitting device based on the measured voltage to compensate variations in properties of the light-emitting device. The display device may include one or more of the following features, either individually or in combination.

In an exemplary embodiment of the display device, the measurement and data processing unit comprises: a measurement unit that is configured to measure the measured voltage through the sample line; a computation unit that is configured to compute an output data voltage value based on the measured voltage and a target voltage data value; and an output unit that is configured to convert the output data voltage value to a data voltage that is supplied to the light emitting device over the data voltage supply line.

In an exemplary embodiment of the display device, the measurement unit is an analogue-to-digital converter that converts the measured voltage to a digital value; the computation unit is a digital operator that computes the output data voltage value based on the digital value and the target voltage data value; and the output unit is a digital-to-analogue converter that converts the output data voltage value into an analogue data voltage that is outputted to the light-emitting device.

In an exemplary embodiment of the display device, the measurement and data processing unit further comprises a memory cell that stores the digital value of the measured voltage, wherein the digital operator obtains the digital value from the memory cell.

In an exemplary embodiment of the display device, the sample line includes a sample switch connected to the second transistor of each pixel circuit, and a sampling capacitor connected between the sample switch and a second voltage supply.

In an exemplary embodiment of the display device, each pixel further comprises a storage capacitor connected between the second terminal of the light-emitting device and a second voltage supply, wherein the storage capacitor discharges through the light-emitting device when the data voltage is disconnected from the pixel circuit.

In an exemplary embodiment of the display device, the second voltage supply comprises a multi-level reference voltage supply, and the reference voltage supply boosts the discharge from the storage capacitor.

In an exemplary embodiment of the display device, the first terminal of the light-emitting device is a cathode and the second terminal of the light emitting device is an anode.

In an exemplary embodiment of the display device, the light-emitting device is one of an organic light-emitting diode, a micro light-emitting diode (LED), or a quantum dot LED.

In an exemplary embodiment of the display device, the plurality of pixel circuits are arranged in the display panel in an array of rows and columns, and the display system further comprises a scan driver and a data driver that supply control signals for operation of the plurality of pixel circuits.

Figure 14:
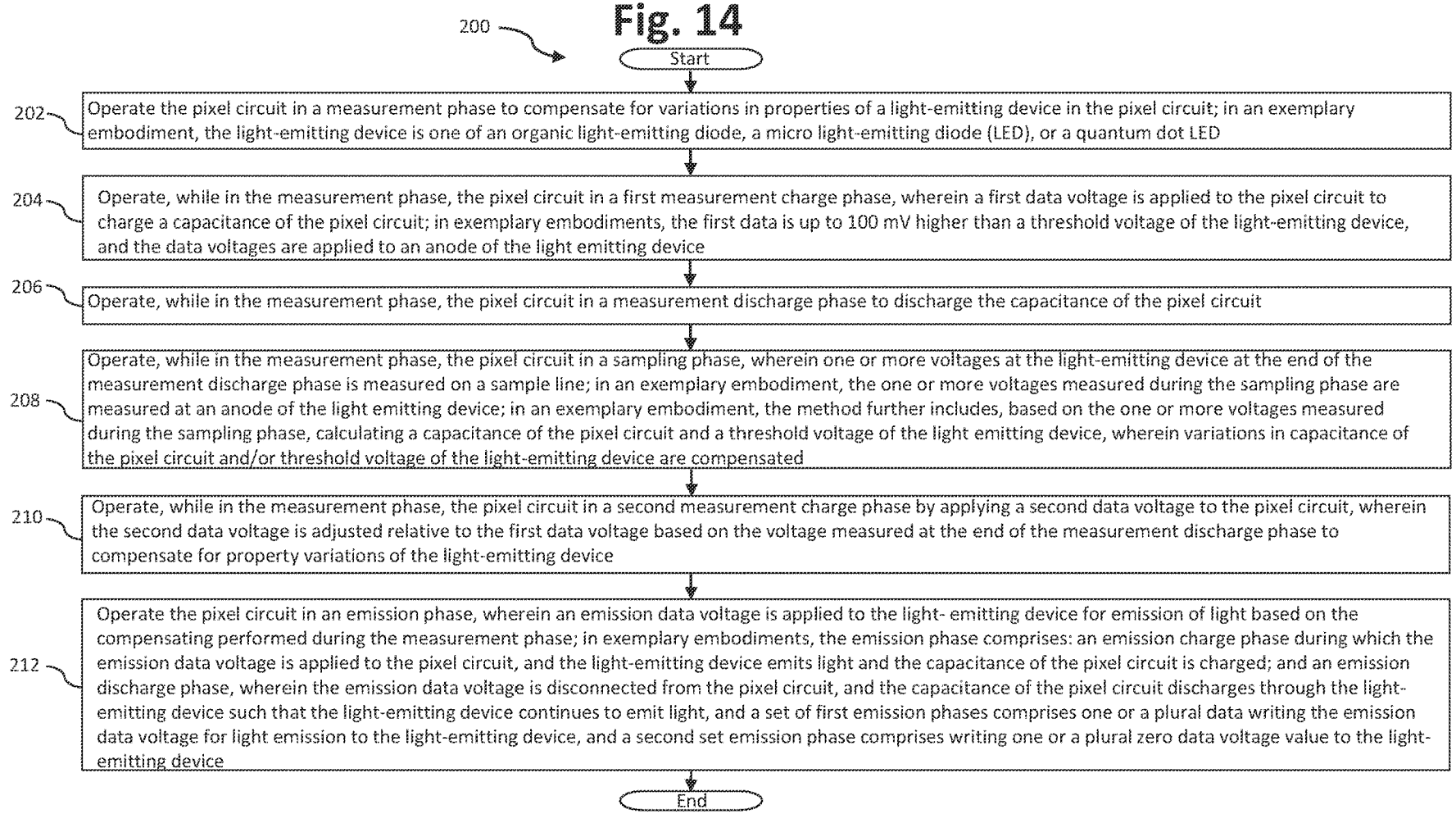
FIG. 14 is a flow chart illustrating exemplary steps for carrying out a method of operating a pixel circuit in accordance with embodiments of the present invention.

Another aspect of the invention is a method of operating a pixel circuit that employs charge programming and compensates for variations in properties of the light-emitting device of the pixel circuit. In exemplary embodiments, and as shown in a flow chart 200 of FIG. 14, the method includes steps of: operating the pixel circuit in a measurement phase to compensate for variations in properties of a light-emitting device in the pixel circuit as indicated at bock 202. The measurement phase comprising steps of: operating the pixel circuit in a first measurement charge phase, wherein a first data voltage is applied to the pixel circuit to charge a capacitance of the pixel circuit as indicated at block 204; operating the pixel circuit in a measurement discharge phase to discharge the capacitance of the pixel circuit as indicated at block 206; operating the pixel circuit in a sampling phase, wherein one or more voltages at the light-emitting device at the end of the measurement discharge phase is measured on a sample line as indicated at block 208; and operating the pixel circuit in a second measurement charge phase by applying a second data voltage to the pixel circuit, wherein the second data voltage is adjusted relative to the first data voltage based on the voltage measured at the end of the measurement discharge phase to compensate for property variations of the light-emitting device as indicated at block 210; and operating the pixel circuit in an emission phase, wherein an emission data voltage is applied to the light emitting device for emission of light based on the compensating performed during the measurement phase as indicated at block 212. The method of operating a pixel circuit may include one or more of the following features, either individually or in combination.

In an exemplary embodiment of the method of operating a pixel circuit, the first data voltage is up to 100 mV higher than a threshold voltage of the light-emitting device as indicated at block 204.

In an exemplary embodiment of the method of operating a pixel circuit, data voltages are applied to an anode of the light emitting device as indicated at block 204.

In an exemplary embodiment of the method of operating a pixel circuit, the emission phase comprises: an emission charge phase during which the emission data voltage is applied to the pixel circuit, and the light-emitting device emits light and the capacitance of the pixel circuit is charged; and an emission discharge phase, wherein the emission data voltage is disconnected from the pixel circuit, and the capacitance of the pixel circuit discharges through the light-emitting device such that the light-emitting device continues to emit light as indicated at block 212.

In an exemplary embodiment of the method of operating a pixel circuit, a set of first emission phases comprises writing one or a plural emission data voltage values for light emission to the light-emitting device, and a set of second emission phases comprises writing one or a plural zero data voltage values to the light-emitting device as indicated at block 212.

In an exemplary embodiment of the method of operating a pixel circuit, the method further includes, based on the one or more voltages measured during the sampling phase, calculating a capacitance of the pixel circuit and a threshold voltage of the light emitting device, wherein variations in capacitance of the pixel circuit and/or threshold voltage of the light-emitting device are compensated.

Figure 15:
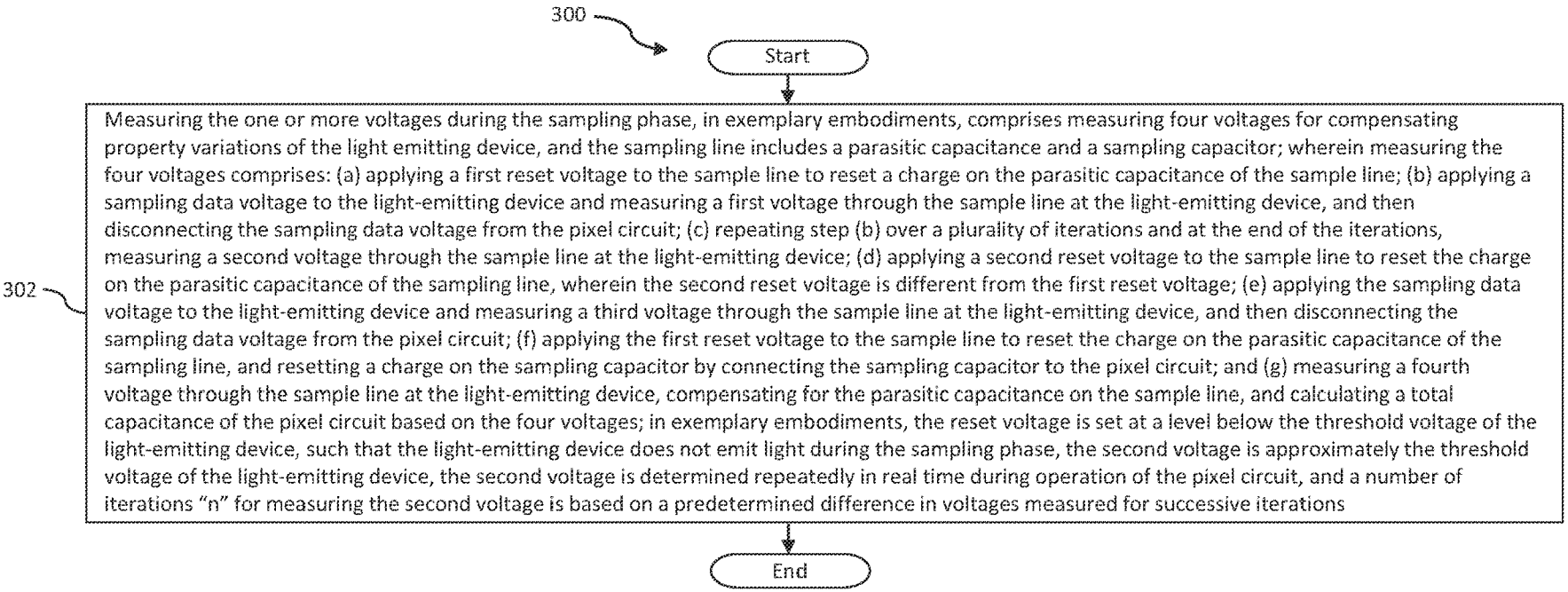
FIG. 15 is a flow chart illustrating further exemplary steps for carrying out a method of operating a pixel circuit in accordance with embodiments of the present invention.

In an exemplary embodiment of the method of operating a pixel circuit, and as shown in a flow chart 300 of FIG. 15, the method further includes compensating for a parasitic capacitance on the sample line as indicated at block 302.

In an exemplary embodiment of the method of operating a pixel circuit, measuring the one or more voltages during the sampling phase comprises measuring four voltages for compensating property variations of the light emitting device, and the sample line includes a parasitic capacitance and a sampling capacitor; wherein measuring the four voltages comprises: (a) applying a first reset voltage to the sample line to reset a charge on the parasitic capacitance of the sample line; (b) applying a sampling data voltage to the light-emitting device and measuring a first voltage through the sample line at the light-emitting device, and then disconnecting the sampling data voltage from the pixel circuit; (c) repeating step (b) over a plurality of iterations and at the end of the iterations, measuring a second voltage through the sample line at the light-emitting device; (d) applying a second reset voltage to the sample line to reset the charge on the parasitic capacitance of the sample line, wherein the second reset voltage is different from the first reset voltage; (e) applying the sampling data voltage to the light-emitting device and measuring a third voltage through the sample line at the light-emitting device, and then disconnecting the sampling data voltage from the pixel circuit; (f) applying the first reset voltage to the sample line to reset the charge on the parasitic capacitance of the sample line, and resetting a charge on the sampling capacitor by connecting the sampling capacitor to the pixel circuit; and (g) measuring a fourth voltage through the sample line at the light-emitting device as indicated at block 302.

In an exemplary embodiment of the method of operating a pixel circuit, the reset voltage is set at a level below the threshold voltage of the light-emitting device, such that the light-emitting device does not emit light during the sampling phase as indicated at block 302.

In an exemplary embodiment of the method of operating a pixel circuit, the method further includes calculating a total capacitance of the pixel circuit based on the four voltages as indicated at block 302.

In an exemplary embodiment of the method of operating a pixel circuit, the second voltage is approximately the threshold voltage of the light-emitting device as indicated at block 302.

In an exemplary embodiment of the method of operating a pixel circuit, the second voltage is determined repeatedly in real time during operation of the pixel circuit as indicated at block 302.

In an exemplary embodiment of the method of operating a pixel circuit, a number of iterations "n" for measuring the second voltage is based on a predetermined difference in voltages measured for successive iterations as indicated at block 302.

In an exemplary embodiment of the method of operating a pixel circuit, the one or more voltages measured during the sampling phase are measured at an anode of the light emitting device as indicated at block 208.

In an exemplary embodiment of the method of operating a pixel circuit, the light-emitting device is one of an organic light-emitting diode, a micro light-emitting diode (LED), or a quantum dot LED as indicated at block 202.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—exemplary display system
12—display panel
14—pixels
16—SCAN driver
18—data driver
20—external measurement and data processing unit
24—external measurement and data processing sub-unit
26—analogue-to-digital converter (ADC)
27—digital-to-analogue converter (DAC)
28—memory cell
29—digital operator
30—first circuit configuration
40—second circuit configuration
50—third circuit configuration

What is claimed is:

1. A method of operating a pixel circuit comprising steps of:

operating the pixel circuit in a measurement phase to compensate for variations in properties of a light-emitting device in the pixel circuit, the measurement phase comprising steps of:

operating the pixel circuit in a first measurement charge phase, wherein a first data voltage is applied to the pixel circuit to charge a capacitance of the pixel circuit;

operating the pixel circuit in a measurement discharge phase to discharge the capacitance of the pixel circuit;

operating the pixel circuit in a sampling phase, wherein one or more voltages at the light-emitting device at the end of the measurement discharge phase is measured on a sample line; and operating the pixel circuit in a second measurement charge phase by applying a second data voltage to the pixel circuit, wherein the second data voltage is adjusted relative to the first data voltage based on the voltage measured at the end of the measurement discharge phase to compensate for property variations of the light-emitting device; and operating the pixel circuit in an emission phase, wherein an emission data voltage is applied to the light emitting device for emission of light based on the compensating performed during the measurement phase.

2. The method of operating a pixel circuit of claim 1, wherein the first data voltage is up to 100 mV higher than a threshold voltage of the light-emitting device.

3. The method of operating a pixel circuit of claim 2, wherein data voltages are applied to an anode of the light emitting device.

4. The method of operating a pixel circuit of claim 1, wherein the emission phase comprises:

an emission charge phase during which the emission data voltage is applied to the pixel circuit, and the light-emitting device emits light and the capacitance of the pixel circuit is charged; and an emission discharge phase, wherein the emission data voltage is disconnected from the pixel circuit, and the capacitance of the pixel circuit discharges through the light-emitting device such that the light-emitting device continues to emit light.

5. The method of operating a pixel circuit of claim 4, wherein a set of first emission phases comprises writing one or a plural emission data voltage values for light emission to the light-emitting device, and a set of second emission phases comprises writing one or a plural zero data voltage values to the light-emitting device.

6. The method of operating a pixel circuit of claim 1, further comprising, based on the one or more voltages measured during the sampling phase, calculating a capacitance of the pixel circuit and a threshold voltage of the light emitting device, wherein variations in capacitance of the pixel circuit and/or threshold voltage of the light-emitting device are compensated.

7. The method of operating a pixel circuit of claim 6, further comprising compensating for a parasitic capacitance on the sample line.

8. The method of operating a pixel circuit of claim 1, wherein measuring the one or more voltages during the sampling phase comprises measuring four voltages for compensating property variations of the light emitting device, and the sample line includes a parasitic capacitance and a sampling capacitor;

wherein measuring the four voltages comprises:

(a) applying a first reset voltage to the sample line to reset a charge on the parasitic capacitance of the sample line;

(b) applying a sampling data voltage to the light-emitting device and measuring a first voltage through the sample line at the light-emitting device, and then disconnecting the sampling data voltage from the pixel circuit;

(c) repeating step (b) over a plurality of iterations and at the end of the iterations, measuring a second voltage through the sample line at the light-emitting device;

(d) applying a second reset voltage to the sample line to reset the charge on the parasitic capacitance of the sample line, wherein the second reset voltage is different from the first reset voltage;

(e) applying the sampling data voltage to the light-emitting device and measuring a third voltage through the sample line at the light-emitting device, and then disconnecting the sampling data voltage from the pixel circuit;

(f) applying the first reset voltage to the sample line to reset the charge on the parasitic capacitance of the sample line, and resetting a charge on the sampling capacitor by connecting the sampling capacitor to the pixel circuit; and (g) measuring a fourth voltage through the sample line at the light-emitting device.

9. The method of operating a pixel circuit of claim 8, wherein the first voltage is set at a level below a threshold voltage of the light-emitting device, such that the light-emitting device does not emit light during the sampling phase.

10. The method of operating a pixel circuit of claim 8, further comprising calculating a total capacitance of the pixel circuit based on the four voltages.

11. The method of operating a pixel circuit of claim 8, wherein the second voltage is approximately a threshold voltage of the light-emitting device.

12. The method of operating a pixel circuit of claim 8, wherein the second voltage is determined repeatedly in real time during operation of the pixel circuit.

13. The method of operating a pixel circuit of claim 8, wherein a number of iterations "n" for measuring the second voltage is based on a predetermined difference in voltages measured for successive iterations.

14. The method of operating a pixel circuit of claim 1, wherein the one or more voltages measured during the sampling phase are measured at an anode of the light emitting device.

15. The method of operating a pixel circuit of claim 1, wherein the light-emitting device is one of an organic light-emitting diode, a micro light-emitting diode (LED), or a quantum dot LED.

* * * * *